US005666751A

United States Patent [19]

Garfinkle

[11] Patent Number: 5,666,751

[45] Date of Patent: Sep. 16, 1997

[54] MODULAR SIGN SYSTEM

[76] Inventor: Benjamin L. Garfinkle, 1120 Portal Ave., Piedmont, Calif. 94610

[21] Appl. No.: 558,255

[22] Filed: Nov. 17, 1995

Related U.S. Application Data

[63] Continuation of Ser. No. 937,521, Aug. 27, 1992, abandoned.

[51] Int. Cl.[6] ..... G09F 7/00

[52] U.S. Cl. ..... 40/605; 40/611; 40/617

[58] Field of Search ..... 40/605, 606, 611, 40/617, 618, 620, 622; 52/38, 690, 786.11, 783.18, 790.1, 793.11

[56] References Cited

U.S. PATENT DOCUMENTS

| | | | |
|---|---|---|---|
| 2,505,673 | 4/1950 | Howenstine | 52/793 X |
| 3,154,870 | 11/1964 | Hopp et al. | 40/605 |
| 4,166,332 | 9/1979 | Donovan | 40/606 X |
| 4,630,386 | 12/1986 | Wilson | 40/155 |
| 4,726,133 | 2/1988 | Rainone et al. | 40/152.1 |
| 5,090,145 | 2/1992 | Chiang et al. | 40/605 |
| 5,099,589 | 3/1992 | Lai | 40/152.1 |

FOREIGN PATENT DOCUMENTS

| | | | |
|---|---|---|---|
| 3821870 | 12/1988 | Germany | 40/606 |

*Primary Examiner*—Brian K. Green
*Attorney, Agent, or Firm*—Malcolm B. Wittenberg

[57] ABSTRACT

A sign system frame for accepting and displaying flexible signage of substantially uniform vertical dimension. One or more substantially uniformly parallel pairs of rail sections are provided each having an outer edge and inner edge. The rail sections have substantially uniform cross sections and longitudinal axes wherein at least one of the rail sections is provided with an open region at its outer edge for accepting connectors for connecting the frame to a support. The inner edge of the rail sections are provided with separator slots and signage slots for accepting and frictionally retaining the flexible signage and separator panels. The separator panels are employed to maintain pairs of rail sections parallel to one another at a distance approximating the uniform vertical dimension of the signage.

3 Claims, 2 Drawing Sheets

MODULAR SIGN SYSTEM

This is a continuation of application Ser. No. 07/937,521 filed on Aug. 27, 1992, now abandoned.

TECHNICAL FIELD OF THE INVENTION

The present invention relates to signs and sign systems particularly those employed in supermarket, drugstore and like environments.

BACKGROUND OF THE INVENTION

Supermarkets, drugstores and similar shopping areas such as the increasingly popular discount warehouse-like shops present unique signage display problems. These unique problems are the result of the necessity to display widely diverse consumer-related products which do not lend themselves to the use of a single signage system. Particularly in discount warehouse-like shopping environments, it is also commonplace to hang signage from a ceiling-like structure in order to attract the even casual shopper to a specific display or sales area.

In the past, retail and wholesale shopping facilities were required to inventory different sign systems depending upon whether the signage was to be hung from a ceiling or supported by a floor standing display such as an easel base support. In addition, prior signage systems were difficult to assemble in the field and, once assembled, were difficult to break down for storage or reassembly in a different storage location. Finally, completely different sign systems were required for signage of different dimension. There continues to be an obvious need to provide signage of various dimensions depending upon the orientation required to promote a given display.

It is thus an object of the present invention to provide a signage system capable being employed within a supermarket or like environment, universally, with minor modification from service area to service area.

It is a further object of the present invention to provide a universally acceptable signage system which can easily be assembled in the field of a snap-fit design which can accommodate signage of varying sizes and which can be broken down and stored conveniently.

These and further objects of the present invention will be more readily appreciated when considering the following description and appended claims.

SUMMARY OF THE INVENTION

The present invention involves a sign system frame for accepting and displaying flexible signage. Signage is generally provided as planar sheet material having a substantially uniform vertical dimension. The frame is comprised of one or more substantially uniformly parallel pairs of rail sections each having an outer edge and inner edge. The rail sections are provided with substantially uniform cross sections and longitudinal axes.

At least one of the rail sections discussed above is provided with an open region at its outer edge for accepting connector means. The connector means are provided for connecting the frame to support means. The rail sections are also provided, at their inner edges with separator slot means and signage slot means. The signage slot means is provided for accepting and frictionally retaining flexible signage while one or more separator panels are provided for frictionally engaging the separator slot means. By use of said separator slot means, rail sections are maintained in parallel pairs at distances approximating the uniform vertical dimension of the flexible signage.

DETAILED DESCRIPTION OF THE INVENTION

Figure 1:
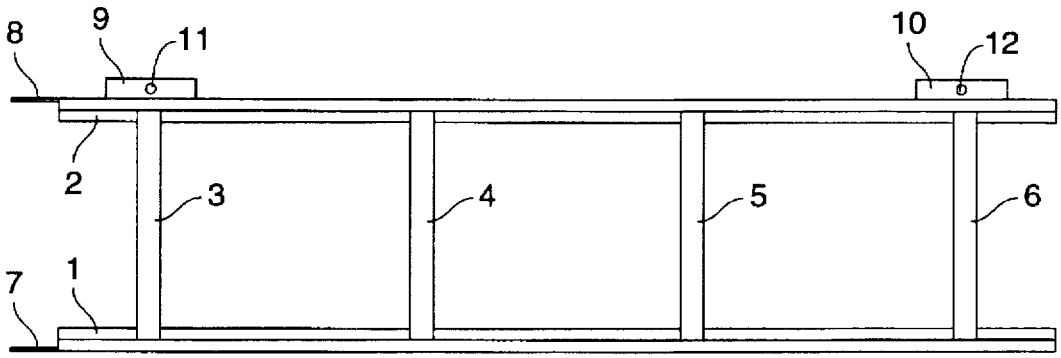
FIG. 1 is a elevation view of the sign system of the present invention.
Figure 2:
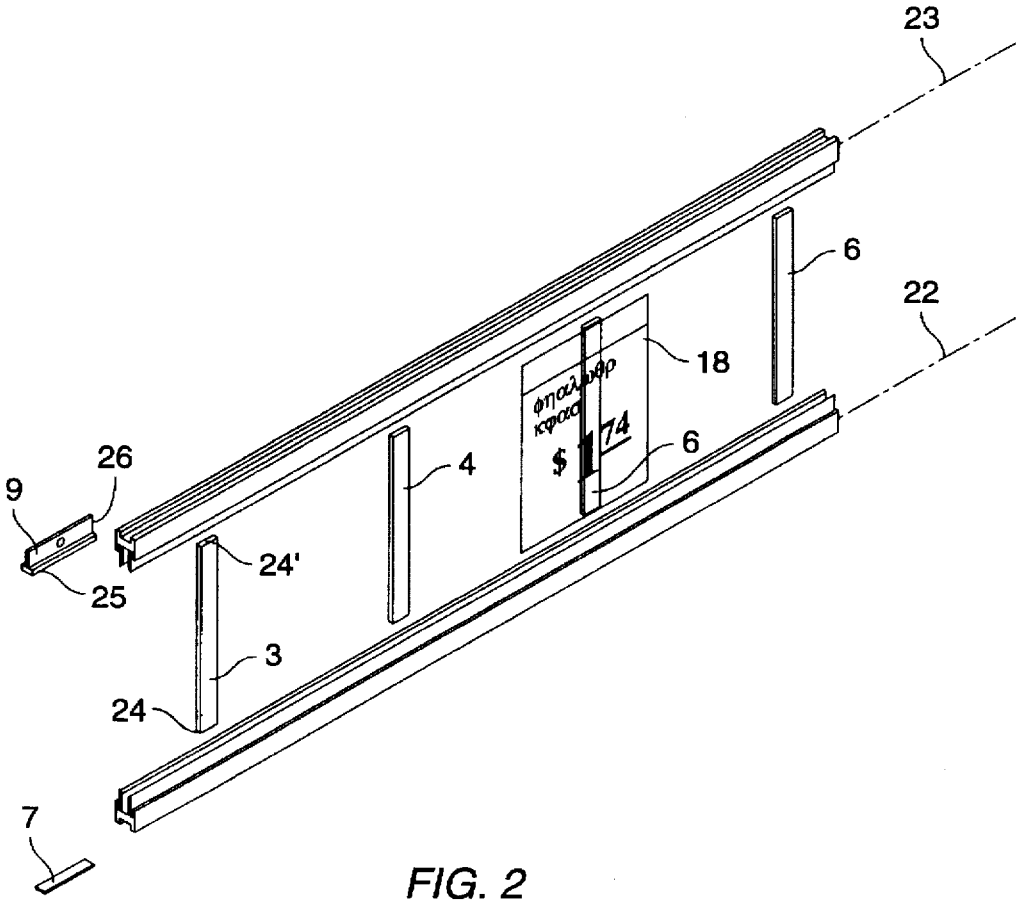
FIG. 2 is an exploded view of the sign system of FIG. 1.

The sign system of the present invention can best be visualized and referenced to FIGS. 1 and 2. It is the object of the present invention to display signage such as that shown in phantom as element 18 (FIG. 2). Such signage is provided with a substantially uniform vertical dimension most commonly in the form of a square or rectangle having parallel, vertical and horizontal edges. It is thus the intent of the signage shown in FIGS. 1 and 2 to display the availability of instant rice at $1.79 for an 8 ounce package, the signage hanging from a ceiling or similar structure presumably over a display of said rice packaging.

Figure 3:
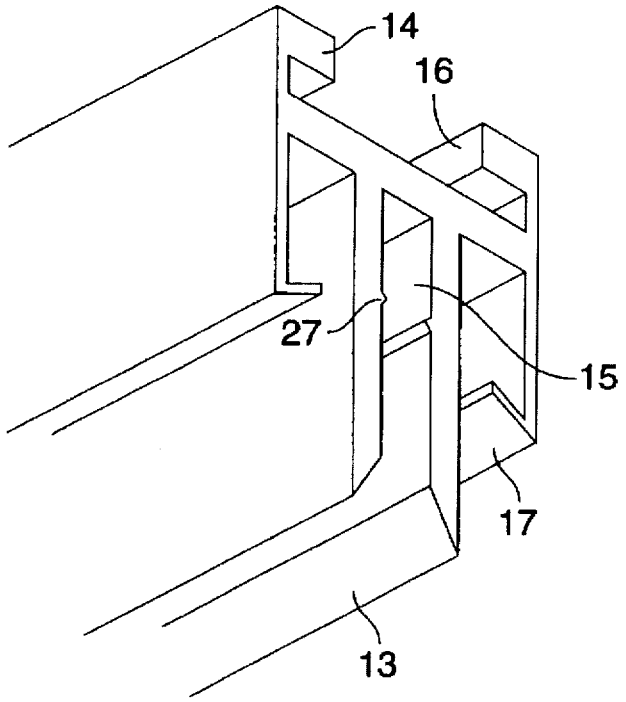
FIG. 3 is a perspective view of a typical rail section and cross-section produced pursuant to the present invention; and, FIG. 4 depicts, in detail, an embodiment for attaching the rail section of FIG. 3 to a suitable support.

The frame comprises parallel pairs 1 and 2 of rail sections each having an outer edge 14 and inner edge 13 noting that the rail sections have a substantially uniform cross section as best seen in FIG. 3 and coextensive longitudinal axes 22 and 23.

At inner edge 13 is provided separator slot means 15. Separator slot means 15 having barbs 27 is configured within rail sections to receive and accommodate separator panels 3, 4, 5 and 6 which frictionally engage and separate rails 1 and 2 to maintain the rail pairs parallel to one another at a distance approximating the vertical dimension of signage 18. Ideally, the various separator panels are provided with detente regions 24 and 24' of reduced cross section for frictionally engaging separator slot means 15.

The various separator panels being frictionally and removably engaged with parallel rail sections 1 and 2. Specifically, the spacing between separator panels can be easily adjusted while the longitudinal length of each separator panel can be altered to change the vertical distance between adjacent rail sections 1 and 2. In this way, signage of different vertical dimensions can be accommodated by simply inventorying separator panels of the appropriate dimension. As such, merchandisers need not maintain and inventory separate sign systems to accommodate signage of different sizes. Only a single set of rails need be maintained and panel sections of varying height inventoried. Such a systems approach to the present sign system invention greatly facilitates its universal application.

System flexibility is further enhanced when considering the various connector means options which are available. Specifically, open region 16 is provided at rail outer edge 14 for accepting connector means for connecting the frame to an appropriate support means. In viewing FIGS. 1 and 2 a first embodiment is depicted whereby connector means 9 is shown in the form of a hanger which consists of a longitudinally extending element of substantially uniform cross section having a base leg 25 and perpendicularly extending transverse leg 26. The base leg is sized to slidably fit within and be received by open region 16. As such, connector means 9 can be slidably accommodated across rail 2 in order to position the sign system directly beneath an appropriate hanger element general emanating from the ceiling or from a beam support structure within the supermarket or like facility. In this regard, hanger element 9 is provided with opening 11 for accepting and retaining a hanger wire (not shown) for hanging the sign system vertically beneath a suitable support.

Figure 4:
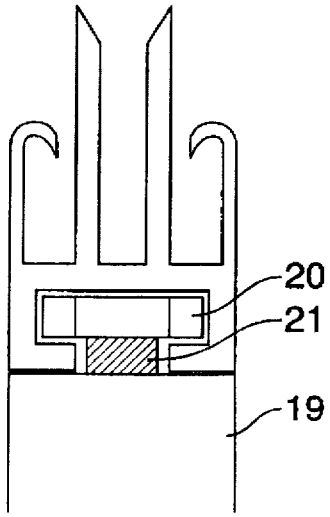

An alternative embodiment is shown in FIG. 4 wherein in this embodiment a threaded male member 21 and threaded female member 20 are provided. Threaded female member 20 can be slid within the T-shaped profile of open region 16 and threaded male member 21 screwably connected thereto in order to support the sign system from a table, flooring or similar structure via connecting rod 19. For example, the sign system can be supported by an easel base (not shown) located on a tabletop and surrounded by produce such as a pyramid of grapefruit, oranges or lemons. The weight of the produce would support the easel base and maintain the sign system in its predetermined location. Furthermore, once threaded female member 20 has been positioned appropriately, by tightening male member 21 therein, the assembly can be fixed in position so that the elements are no longer slidable within open region 16.

It is further noted that signage 18 in fitting within signage slot means 17 can not only be easily removed from the sign system of the present invention but can also slide along the various rail members in order to position the signage in proximity to the merchandise being displayed. The sign system can also accommodate multiple sign elements in adjacent positions the limitation only being the length of the rails themselves when considered with respect to the width of the aggregate signage members.

The sign system of the present invention can be horizontally extended virtually indefinitely through the use of splicer bars 7 and 8. The splicer bars comprise longitudinally extending elements of substantially uniform cross section for frictionally engaging open regions 16 of adjacent rail sections. As shown, approximately half of each splicer bar is frictionally inserted into terminal ends of adjacent rail sections to provide for continuous rails along longitudinal axes 22 and 23. As such, the merchandiser can maintain an inventory of rail sections standard in length and need not be concerned with the need to inventory varying lengths of fixed sign supports as was required by the prior art. Therefore, enhanced flexibility is achievable by such a systems approach to the present signage invention

I claim:

1. A sign system for accepting and displaying flexible signage, said sign system comprising:

a) flexible signage of substantially uniform vertical dimension;

b) one or more separator panels;

c) connector means for connecting said sign system to support means; and d) at least one pair of rail sections wherein each said rail section has:

1) An outer edge;

2) an inner edge;

3) substantially uniform cross section;

4) a longitudinal axis;

5) signage slot means at the inner edge for accepting and frictionally retaining said flexible signage;

6) separator slot means at the inner edge for frictionally engaging said separator panels so that said one or more separator panels are positionable anywhere along said rail sections within said separator slot means and when installed together with said flexible signage reside behind said signage wherein only said one or more separator panels maintain said rail sections as parallel pairs; and wherein at least one of said rail sections is provided with an open region at its outer edge for accepting and retaining said connector means and wherein said one or more separator panels are provided with detent regions of reduced cross-section and said separator slot means are provided with barbs for frictionally engaging and retaining said one or more separator panels.

2. A sign system for accepting and displaying flexible signage, said sign system comprising:

a) flexible signage of substantially uniform vertical dimension;

b) one or more separator panels;

c) connector means for connecting said sign system to support means; and d) at least two pair of rail sections wherein each said rail section has:

1) An outer edge;

2) an inner edge;

3) substantially uniform cross section;

4) a longitudinal axis;

5) signage slot means at the inner edge for accepting and frictionally retaining said flexible signage;

6) separator slot means at the inner edge for frictionally engaging said one or more separator panels so that said one or more separator panels are positionable anywhere along said rail sections within said separator slot means and when installed together with said flexible signage reside behind said signage wherein only said one or more separator panels maintain said rail sections as parallel pairs; and wherein at least one of said rail sections is provided with an open region at its outer edge for accepting and retaining said connector means and wherein said at least two pairs of rail sections are attached to one another along the longitudinal axes thereof by use of a splicer bar.

3. The sign system of claim 2 wherein said splicer bar comprises a longitudinally extending element of substantially uniform cross section for frictionally engaging open regions of adjacent rail sections.

* * * * *